US006783180B1

(12) United States Patent
Young

(10) Patent No.: US 6,783,180 B1
(45) Date of Patent: Aug. 31, 2004

(54) CHAIR TILT LOCK MECHANISM

(76) Inventor: Phillip Young, 828 Scudder Way, Monterey Park, CA (US) 91754

( * ) Notice: Subject to any disclaimer, the term of this patent is extended or adjusted under 35 U.S.C. 154(b) by 0 days.

(21) Appl. No.: 10/665,082

(22) Filed: Sep. 16, 2003

(51) Int. Cl.[7] ..... A47C 3/026

(52) U.S. Cl. ..... 297/344.19; 297/302.1; 297/302.4

(58) Field of Search ..... 297/302.1, 302.3, 297/302.4, 344.19; 248/157, 161, 371, 404, 631

(56) References Cited

U.S. PATENT DOCUMENTS 4,555,085 A * 11/1985 Bauer et al. ..... 297/302.4
4,561,693 A * 12/1985 Brownlie et al. ..... 297/344.19
4,948,198 A * 8/1990 Crossman et al. ..... 297/303.4
5,427,434 A * 6/1995 Hybarger ..... 297/301.4
6,276,755 B1 * 8/2001 Su ..... 297/302.4
6,425,633 B1 * 7/2002 Wilkerson et al. ..... 297/300.2
6,692,077 B1 * 2/2004 Beggs et al. ..... 297/344.19

* cited by examiner

*Primary Examiner*—Peter R. Brown
(74) *Attorney, Agent, or Firm*—Frederick Gotha

(57) ABSTRACT

This invention is an improved tilt lock device for chairs having a spindle and piston for raising and lowering the chair. The improvement consists of a pawl plate for engagement with the piston where the pawl plate is integral with a locking shaft that extends from the chair. The pawl plate contains a barrier rib that is disposed in the upper surface of the plate and is compressively biased by a torsion spring extension. Axial displacement of the locking shaft is precluded when the torsion spring is in bias engagement with the barrier rib. To overcome the bias, the locking shaft requires the application of an axial external force and remains locked until such force overcomes the bias of the barrier rib.

8 Claims, 3 Drawing Sheets

CHAIR TILT LOCK MECHANISM

FIELD OF THE INVENTION

This invention relates to a chair tilt lock mechanism having a single lever to lock the tilt mechanism where the lever is externally biased to prevent the mechanism from unlocking.

BACKGROUND OF THE INVENTION

Chair tilt and height adjustment mechanisms having a single control lever or locking shaft to lock the backrest of the chair into the upright position and to adjust the height of the chair are known in the prior art. Typically, the locking shaft is carried by a housing so as to permit both rotation and lateral movement of the locking shaft relative to the housing, where the height adjustment of the chair seat is controlled by rotational actuation of a gas cylinder mounted to the housing.

A typical prior art tilt mechanism is disclosed in U.S. Pat. No. 5,427,434. The tilt lock mechanism utilizes a tilt lock pawl that is in fixed relationship with the locking shaft such that lateral movement of the shaft shifts the tilt lock pawl into a position whereby relative movement between the housing and bracket plate attached to the seat of the chair is precluded. The tilt lock pawl may be biased by a spring that also biases the locking shaft. When the locking shaft is laterally displaced a sufficient distance, the spring pivots in order to bias the locking lever against opposite lateral movement. The lateral bias prevents the locking shaft from returning to an unlocked position which would result in unwanted rotation of the chair from the upright position. Repeated lateral movement of the locking shaft, however, fatigues the spring and thus weakens the bias force exerted by the spring acting to prevent lateral movement of the locking shaft. Thus, the weakened spring and consequent inability of the bias force to prevent lateral movement of the locking shaft may result in an inadvertent release of the lock of the chair tilt mechanism that permits the chair to rotate.

It would be a desirable feature of a chair tilt mechanism to prevent inadvertent release of the tilt lock. This may be accomplished by providing a locking shaft that may be extended through both the housing and the bracket plate which is attached to the seat of the chair such that the bracket plate and housing are locked together and the locking shaft is compressively retained in the lock position by a barrier which precludes lateral movement of the locking shaft after the chair is tilted and locked in position.

SUMMARY OF THE INVENTION

There is, therefore, provided according to the present invention, a chair tilt locking mechanism that biases a locking shaft so as to prevent lateral movement of the shaft where the bias force results from an extension of a torsion spring compressively engaged against a barrier carried by the locking shaft.

The present invention is directed to an improved chair tilt lock mechanism that consists of a spindle housing having a horizontal axis and a bracket member that is pivotally mounted to the housing. A pivot pin extends laterally through both the spindle housing and the bracket member to permit relative rotational movement of the bracket member with respect to the spindle housing. The bracket member has a base that is so constructed and designed to permit the bracket member to be fastened to the under side of a chair.

To raise or lower the chair seat, the spindle housing telescopically engages a spindle member where the spindle member may be raised or lowered by a piston arrangement. To move the chair from one location to another, the spindle member is supported by a plurality of legs attached to casters to permit rolling action of the chair. A locking shaft is carried by both the spindle housing and the bracket member and is so adapted for carriage to permit rotation and lateral movement of the locking shaft relative to both the spindle housing and the bracket member. A pawl plate is fixed to and integral with the locking shaft such that the pawl plate is carried in fixed relationship with the locking shaft during lateral or rotational displacement of the locking shaft.

The bracket member has a pair of rails extending from the base through which the pivot pin extends laterally to permit relative rotation between the spindle housing and the bracket member; one of the bracket member rails contains a slot and the other rail contains a pair of apertures. When the locking shaft extends laterally through an aperture, the spindle housing and bracket are locked and precluded from rotation relative to each other. If the locking shaft does not extend through either of the apertures, the chair may be tilted by rotation of the bracket member relative to the spindle housing. Thus, upon lateral extension of the locking shaft into either of the apertures, the bracket member will be locked rotationally to the spindle housing to preclude relative rotation between the two. To prevent the locking shaft from inadvertently retracting from an aperture to unlock the bracket member and thereby permit rotation or pivoting with respect to the spindle housing, a pawl member is mounted so as to rotate relative to the pivot pin where the pawl member has a first end that is biased by a first extension of a torsion spring carried by the pivot pin. The torsion spring has a second extension that is biased against the pawl plate in a compressive relationship throughout any rotational or lateral movement of the pawl plate. The pawl plate has a barrier rib that extends from its surface that prevents lateral movement of the locking shaft; lateral movement is precluded when the second extension of the torsion spring compressively bears against the barrier rib which occurs when the locking shaft extends through either aperture. During either rotational or lateral movement of the locking shaft, the second extension of the torsion spring remains in compressive engagement with the pawl plate. Thus, when the locking shaft extends through an aperture thereby locking the spindle housing and bracket member, the second extension of the torsion member laterally bears against the barrier rib of the pawl plate which prevents lateral movement of the locking shaft; sufficient lateral movement of the locking shaft would inadvertently unlock the spindle housing and the bracket member allowing relative rotation between the spindle housing and the bracket member.

The bracket member and spindle housing are biased by a coil spring such that the seat of the chair upon being tilted from the horizontal will be urged by the coil spring to return to the horizontal. The coil spring is carried by the spindle housing and associated with a bolt carried by the bracket member such that rotation of the bracket member relative to the housing will compress the coil spring; the compressed coil spring applies a restoring force to the bracket member thereby biasing the bracket member towards the horizontal. The improved tilt lock mechanism of this invention utilizes the second extension of a torsion spring to compressively engage a barrier rib that is carried by the locking shaft so as to preclude lateral movement of the locking shaft and thus prevent the bracket member from becoming unlocked rotationally with respect to the spindle housing.

BRIEF DESCRIPTION OF THE DRAWINGS

These and other features and advantages will become appreciated as the same become better understood with reference to the following specification, claims and drawings wherein:

DETAILED DESCRIPTION

Figure 1:
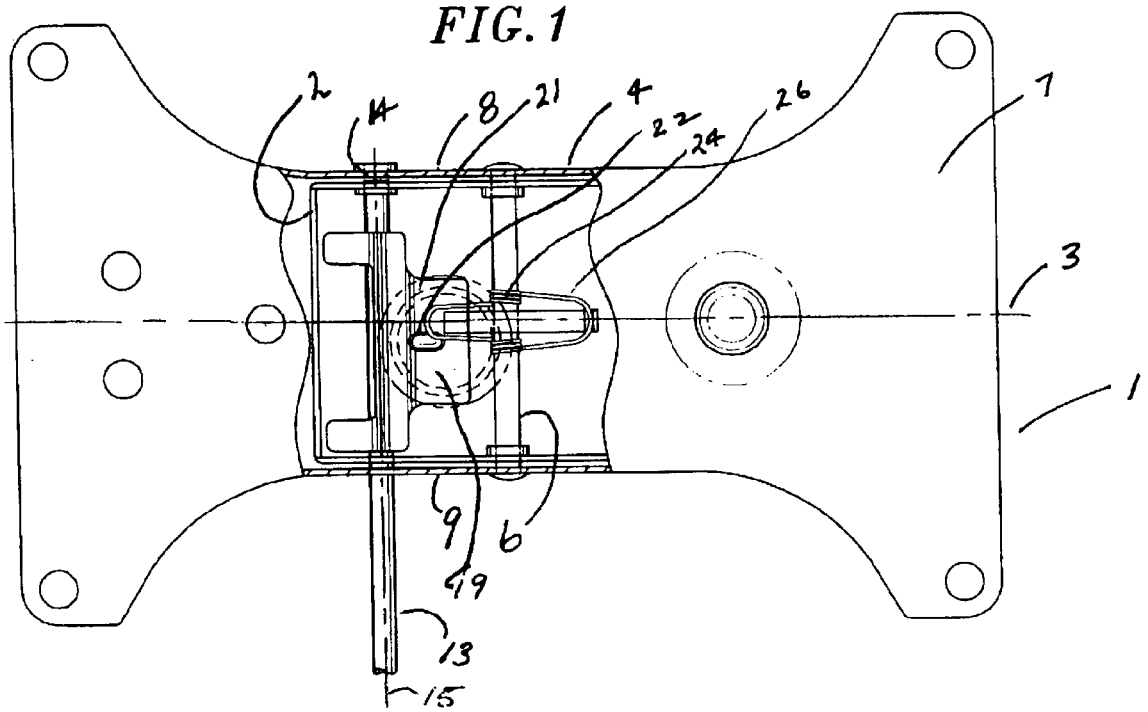
FIG. 1 is a part cross-sectional top view of this invention illustrating the chair tilt lock mechanism of this invention in the first position where the locking shaft is in an unlocked position with respect to the spindle housing and bracket member.
Figure 2:
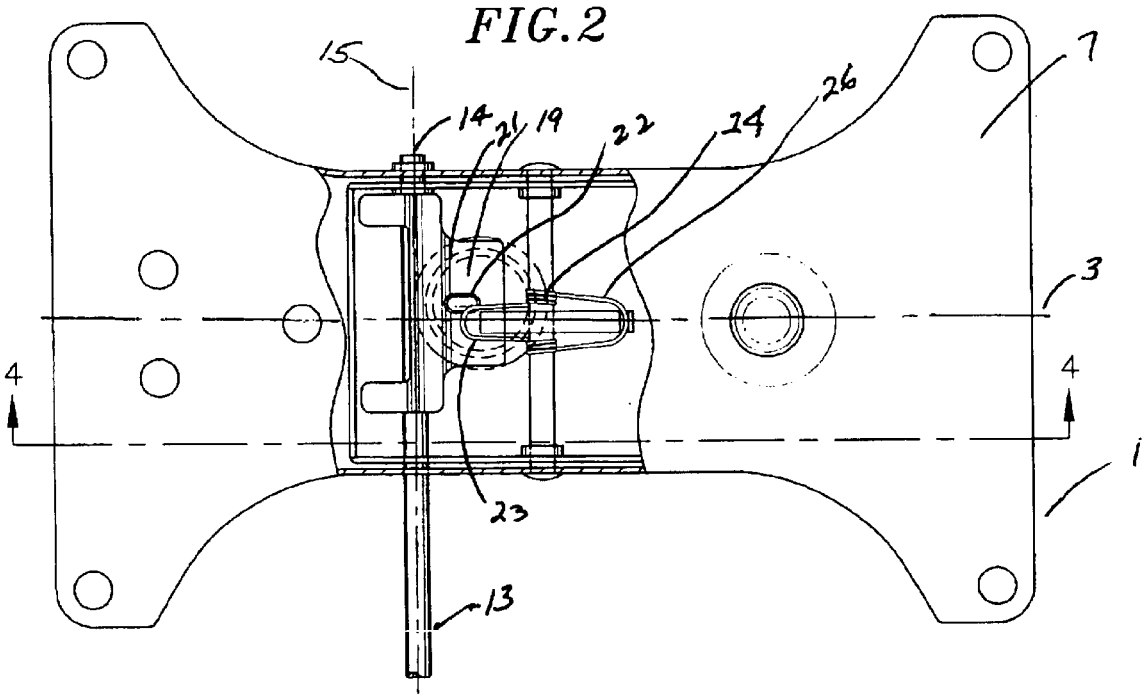
FIG. 2 is a part cross-sectional top view of this invention illustrating the locking shaft in a locked position with respect to the spindle housing and bracket member.
Figure 3:
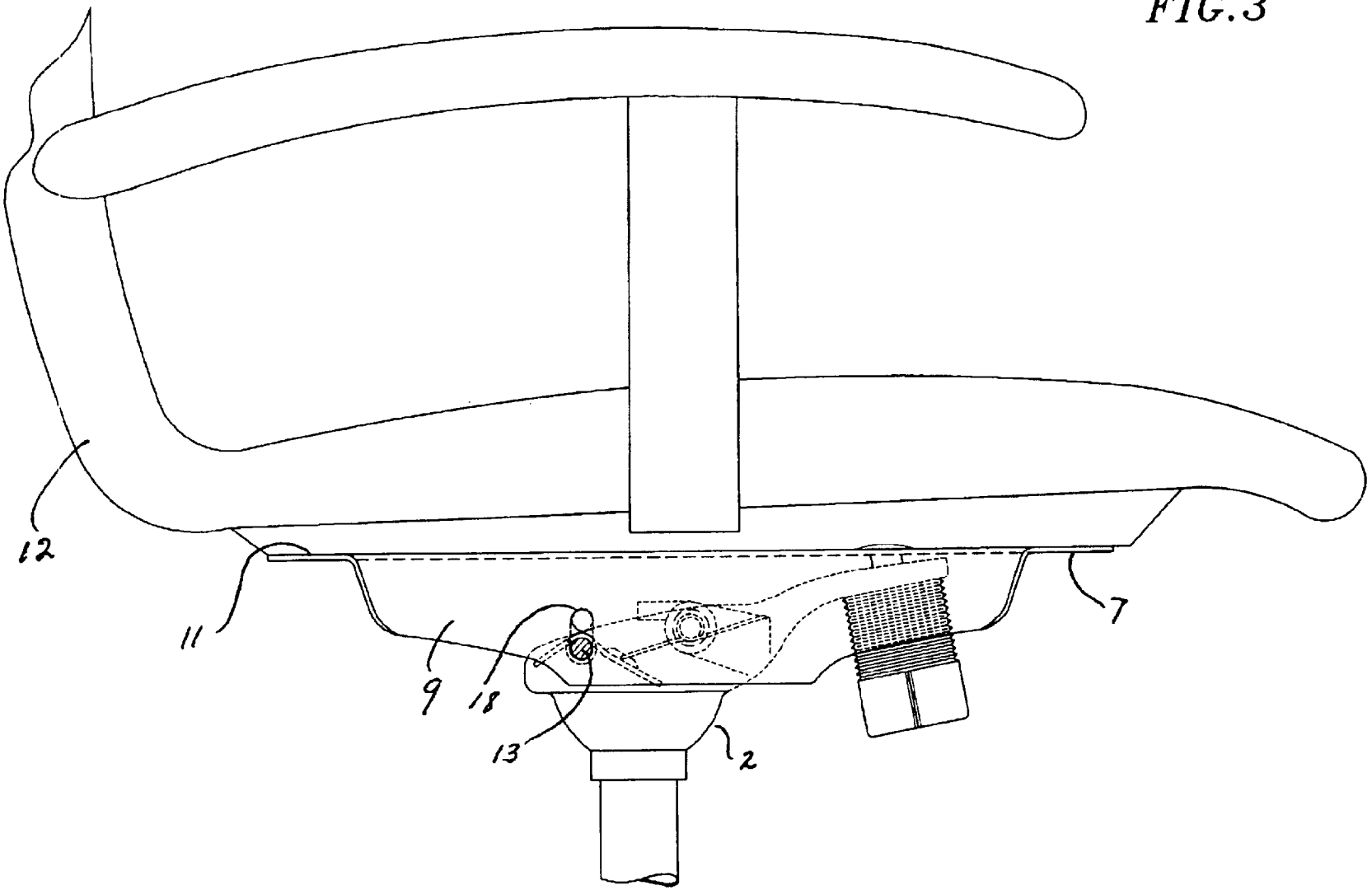
FIG. 3 is a front view of FIG. 1 illustrating the chair tilt lock mechanism of this invention fastened to the underside of a chair with the locking shaft shown in cross section.

FIG. 3 represents a front view of this invention and FIG. 1 and FIG. 2 are top views that illustrate the tilt locking mechanism 1 in unlocked and locked configurations. By referring to FIG. 1 which is a part cross-sectional top view illustrating the unlocked configuration, tilt lock mechanism 1 can be seen to be composed of a spindle housing 2 that has a horizontal axis 3 where spindle housing 2 is pivotally connected to bracket member 4 by pivot pin 6. As can be seen by reference to FIGS. 1 and 3, bracket member 4 has a base 7 and a pair of thin walled rails 8, 9 that are parallel to each other and extend perpendicularly from base 7 to form a bracket. Although the fasteners are not shown, base 7 of bracket member 4 is fastened to the underside 11 of chair 12 and as can further be seen by reference to FIG. 3, rotation of bracket member 4 with respect to spindle housing 2 will result in underside 11 of chair 12 being tilted from the horizontal.

Referring again to FIG. 1 which illustrates the unlocked configuration of locking shaft 13, it can be seen that locking shaft 13 has an end portion 14 where end portion 14 is laterally removed from and does not extend into rail 8 of bracket member 4; this represents the unlocked configuration which permits relative rotation between the spindle housing and bracket member. Locking occurs when locking shaft 13 laterally extends into the rail.

Figure 4:
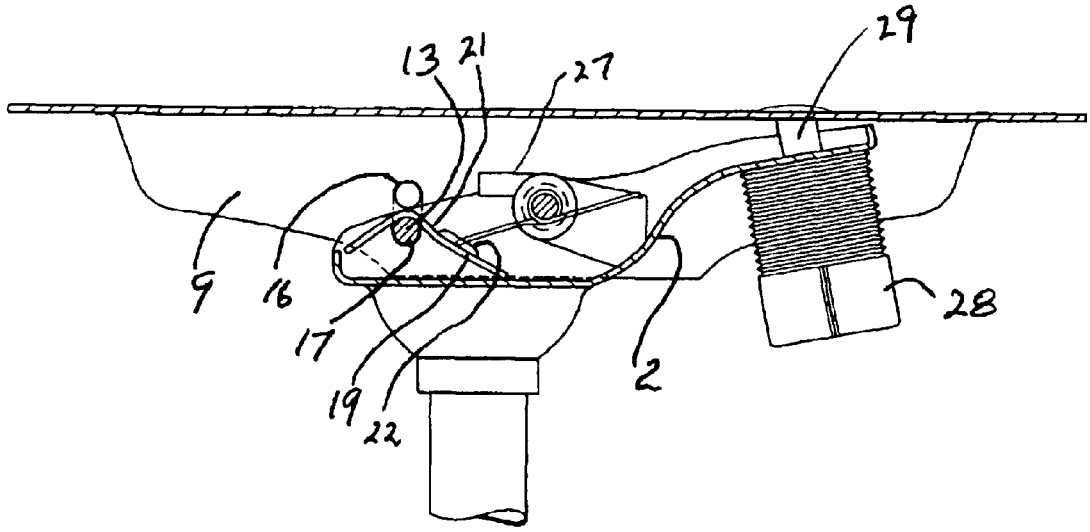
FIG. 4 is a cross-sectional view of FIG. 2 taken along the line 4—4.

Locking shaft 13 has an axis of extension and is carried by spindle housing 2 so as to permit lateral displacement in an axial direction and angular rotation of the locking shaft about the axis to lock and unlock the spindle housing and bracket member. By referring to FIGS. 4 and 5, it can be seen that bracket member 8 has apertures 16,17 into which the end portion 14 of locking shaft 13 may be inserted to rotationally lock bracket member 4 and the spindle housing 2 together. FIG. 2 illustrates end portion 14 of locking shaft 13 extending through aperture 17 which locks bracket member 4 in the horizontal position. When locking shaft 13 is withdrawn from either apertures 16 or 17, bracket member 4 and spindle housing 2 will be unlocked rotationally. Relative rotation between bracket member 4 and spindle housing 2, since the locking shaft is in fixed spatial relationship with the spindle housing, is achieved by utilizing a slot 18 located in rail 9 and extending therethrough essentially in a vertical direction which permits bracket member 4 to slide relative to locking shaft 13. When locking shaft 13 is in the unlocked position, bracket member 4 may be rotated with respect to the spindle housing since essentially vertical slot 18 permits movement of bracket member 4 relative to locking shaft 13. Although the locking shaft is spatially fixed with respect to spindle housing 2, it is so carried that the locking shaft can move laterally or rotationally with respect to the spindle housing. Thus, as the bracket member 4 pivots about pivot pin 6, slot 18 will permit relative movement of the locking shaft with respect to spindle housing 2 to permit the tilt from the horizontal of the chair 12.

As described above, the tilt lock mechanism of this invention utilizes a locking shaft in two configurations, namely, where the locking shaft 13 is in the unlocked position as shown in FIG. 1 and in the locked position as shown in FIG. 2. To prevent inadvertent movement of the locking shaft resulting in an unlocked from a locked configuration and consequent rotation of the bracket member 4, a barrier to lateral movement of the locking shaft is utilized. In FIG. 1, a pawl plate 19 is carried by locking shaft 13 and is integral with locking shaft 13 such that the pawl plate is locked for lateral and rotational movement with the locking shaft. Pawl plate 19 has an upper surface 21 that contains a barrier rib 22 that projects from upper surface 21 so as to form a hump type barrier in an otherwise smooth surface. When the locking shaft 13 is in the locked position, i.e. end portion 14 of the locking shaft extends through aperture 17 of rail 8, second extension 23 of torsion spring 24 compressively bears against upper surface 21 of the pawl plate and also compressively bears laterally against barrier rib 22 so as to prevent lateral movement of locking shaft 13 in a direction that would permit end portion 14 of the locking shaft to inadvertently retract from an aperture and unlock the tilt mechanism. Torsion spring 24 is carried by pivot pin 6 and has a first extension 26 that biases pawl member 27. Although not shown, but illustrated in U.S. Pat. No. 5,427,434, a spindle member is telescopically mounted to the spindle housing and as in the prior art, when the spindle member engages the lower surface of pawl plate 19, rotation of locking shaft 13 will rotate pawl plate 19 so as to place the upper portion of the spindle in compression and thereby through a piston arrangement permit the chair seat to be raised and lowered.

Bracket member 4, when displaced from the horizontal by rotation about pivot pin 6, is biased by a spring force to return to the horizontal position. A coil spring (not shown) is enclosed within casing 28 and compressively bears against spindle housing 2. A bolt 29 is so attached to the coil spring that upon rotation of bracket member 4 about pivot pin 6, the coil spring will be compressed and exert a bias force on bracket member 4 so as to return the bracket member to the horizontal position.

The operation of the tilt lock mechanism of this invention can be described by reference to FIGS. 1 and 2. In FIG. 1, which depicts the unlocked configuration of this invention, end portion 14 of locking shaft 13 does not extend into either orifice 16 or 17 which are both contained in rail 8. In the unlocked configuration, pawl plate 19 and barrier rib 22 are compressively engaged by second extension 23 of torsion spring 24. Lateral compressive engagement of barrier rib 22 by second extension 23 of the torsion spring precludes inadvertent lateral movement of the locking shaft.

Figure 5:
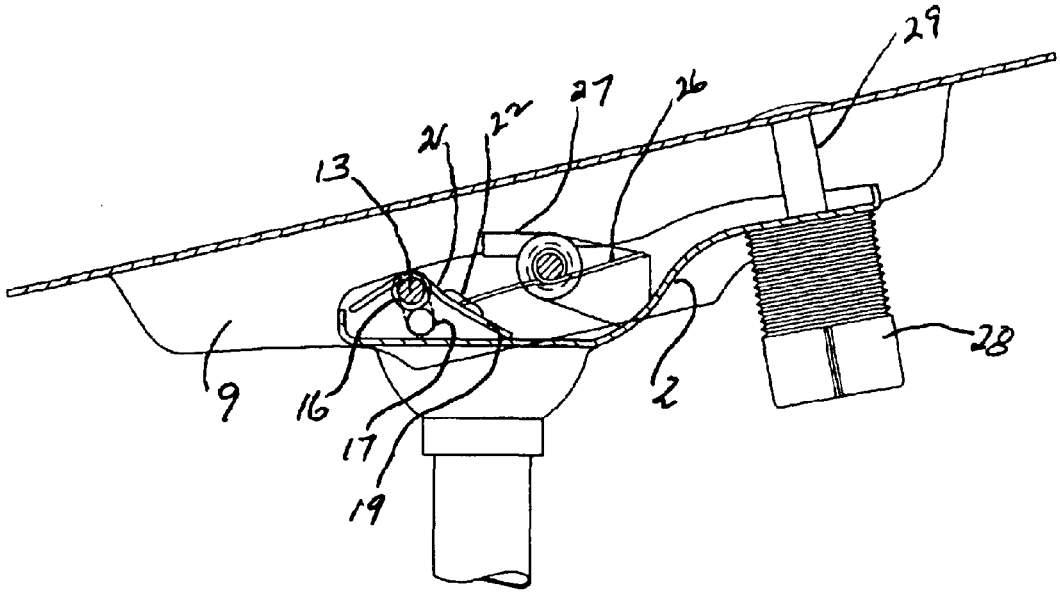
FIG. 5 is a cross-sectional view taken along the line 4—4 of FIG. 2 where the chair tilt mechanism has been tilted from the horizontal.

In the configuration as shown in FIG. 1, bracket member 4 is unlocked to rotate relative to spindle housing 2 to a position of tilt illustrated in FIG. 5. To prevent inadvertent rotation of bracket member 4 from the horizontal, locking shaft 13 may be laterally moved with sufficient force to overcome the bias exerted laterally against the barrier rib by the second extension of the torsion spring. Overcoming the barrier rib bias permits end portion 14 of locking shaft 13 to extend into aperture 16 or 17 thereby locking the spindle housing 2 and the bracket member 4 rotationally. The second extension 23 of coil spring 24 again compressively engages the upper surface of pawl plate 19 but compressively engages the opposite side of barrier rib 22 so as to prevent lateral movement of the locking shaft and thus retains the lock between bracket member 4 and spindle housing 2. Likewise, as shown in FIG. 5 and FIG. 2, to retain the locked position of the bracket member with respect to the spindle housing after the chair has been tilted, the locking shaft 13 can be laterally moved with sufficient force to overcome the bias of the second extension of the torsion spring and can laterally be extended into aperture 16 to rotationally lock bracket member 4 and spindle housing 2 together. The bias exerted by the second extension of the torsion spring against the barrier rib now prevents inadvertent lateral movement of the locking shaft that would permit end portion 14 of the locking shaft to withdraw from aperture 17 and thus unlock the tilt mechanism.

While I have shown and described embodiments of an improved tilt lock mechanism, it is to be understood that the invention is subject to many modifications without departing from the scope and spirit of the claims as recited herein.

What is claimed is:

1. An improved tilt lock device for a chair having a spindle member and piston for raising or lowering the chair, comprising:

(a) a spindle housing mounted to said spindle member and piston where said spindle housing has a horizontal axis;

(b) a pivot pin carried by said spindle housing and extending laterally with respect to said horizontal axis through said spindle housing;

(c) a bracket member pivotally mounted to said pivot pin for rotation relative to said spindle housing;

(d) a locking shaft having an axis of elongation slidably carried by said bracket member and by said spindle housing, said locking shaft extending laterally with respect to said horizontal axis through said spindle housing and at least in part through said bracket member where said locking shaft is responsive to external force for axial displacement and is so adapted for carriage by said spindle housing and said bracket member to permit slidable axial displacement of said locking shaft with respect to said axis of elongation upon the application of said external force;

(e) a pawl plate for engagement with said piston for raising or lowering said chair having an upper surface and a lower surface where said pawl plate is fixed for rotation with said locking shaft and extends laterally to said axis of elongation;

(f) a barrier rib disposed in said upper surface of said pawl plate and projecting above said upper surface, said barrier rib extending laterally with respect to said axis of elongation;

(g) a pawl member carried by said pivot pin and mounted to permit rotation of said pawl member with respect to said pivot pin; and (h) a torsion spring carried by said pivot pin having a first extension and a second extension for compressively biasing both said pawl member and said pawl plate respectively so as to oppose rotation of said pawl plate, where said first extension compressively engages said pawl member and said second extension compressively engages said upper surface of said pawl plate thereby biasing said second extension against said barrier rib axially with respect to said axis of elongation whereby said locking shaft is precluded from axial displacement with respect to said axis of elongation without application of said external force applied to said locking shaft to overcome the bias of said second extension against said barrier rib.

2. The improved tilt lock device recited in claim 1 where said bracket member comprises a base for attachment to said chair laterally symmetrical with respect to said horizontal axis, and a first rail and second rail integral with and extending from said base in a direction orthogonal to said axis of elongation, said first and second rails laterally and oppositely spaced with respect to said horizontal axis, where said first rail contains a slot extending therethrough for receiving said locking shaft to permit rotation of said bracket member with respect to said locking shaft and where said second rail has a plurality of apertures extending therethrough for receiving said locking shaft such that extension of said locking shaft into one of said plurality of apertures locks said bracket member and said spindle housing together rotationally.

3. The improved tilt lock device recited in claim 2 where said spindle housing has a first opening adjacent said first rail and a second opening adjacent said second rail for receiving said locking shaft such that when said locking shaft extends through both said first and second openings said locking shaft is in fixed spatial relationship with said spindle housing.

4. The improved tilt lock device recited in claim 3 further comprising a coil spring means associated with said bracket member and said spindle housing for biasing said bracket member upon rotation with respect to said spindle housing.

5. An improved tilt lock device for a chair of the type having a spindle member and piston for raising or lowering the chair, a spindle housing mounted to said spindle member and piston where said spindle housing has a horizontal axis, a pivot pin carried by said spindle housing and extending laterally with respect to said horizontal axis through said spindle housing, a bracket member pivotally mounted to said pivot pin for rotation relative to said spindle housing, a locking shaft having an axis of elongation slidably carried by said bracket member and by said spindle housing, said locking shaft extending laterally with respect to said horizontal axis through said spindle housing where said locking shaft is responsive to external force for axial displacement and is so adapted for carriage by said spindle housing and said bracket member to permit slidable axial displacement of said locking shaft with respect to said axis of elongation upon the application of said external force, the improvement comprising:

(a) a pawl plate for engagement with said piston for raising or lowering said chair having an upper surface and a lower surface where said pawl plate is fixed for rotation with said locking shaft and extends laterally to said axis of elongation;

(b) a barrier rib disposed in said upper surface of said pawl plate and projecting above said upper surface, said barrier rib extending laterally with respect to said axis of elongation;

(c) a pawl member carried by said pivot pin and mounted to permit rotation of said pawl member with respect to said pivot pin; and (d) a torsion spring carried by said pivot pin having a first extension and a second extension for compressively biasing both said pawl member and said pawl plate respectively so as to oppose rotation of said pawl plate, where said first extension compressively engages said pawl member and said second extension compressively engages said upper surface of said pawl plate thereby biasing said second extension against said barrier rib axially with respect to said axis of elongation whereby said locking shaft is precluded from axial displacement with respect to said axis of elongation without application of said external force applied to said locking shaft to overcome the bias of said second extension against said barrier rib.

6. The improved tilt lock device recited in claim 5 where said bracket member comprises a base for attachment to said chair laterally symmetrical with respect to said horizontal axis, and a first rail and second rail integral with and extending from said base in a direction orthogonal to said axis of elongation, said first and second rails laterally and oppositely spaced with respect to said horizontal axis, where said first rail contains a slot extending therethrough for receiving said locking shaft to permit rotation of said bracket member with respect to said locking shaft and where said second rail has a plurality of apertures extending therethrough for receiving said locking shaft such that extension of said locking shaft into one of said plurality of apertures locks said bracket member and said spindle housing together rotationally.

7. The improved tilt lock device recited in claim 6 where said spindle housing has a first opening adjacent said first rail and a second opening adjacent said second rail for receiving said locking shaft such that when said locking shaft extends through both said first and second openings said locking shaft is in fixed spatial relationship with said spindle housing.

8. The improved tilt lock device recited in claim 7 further comprising a coil spring means associated with said bracket member and said spindle housing for biasing said bracket member upon rotation with respect to said spindle housing.

* * * * *